US008901060B2

(12) United States Patent
Faβbender et al.

(10) Patent No.: US 8,901,060 B2
(45) Date of Patent: Dec. 2, 2014

(54) USE OF THIOGLYCOL ETHOXYLATE AS A CORROSION INHIBITOR

(75) Inventors: Stefan Faβbender, Speyer (DE); Peter Kolb, Ludwigshafen (DE)

(73) Assignee: BASF SE, Ludwigshafen (DE)

( * ) Notice: Subject to any disclaimer, the term of this patent is extended or adjusted under 35 U.S.C. 154(b) by 709 days.

(21) Appl. No.: 13/129,594

(22) PCT Filed: Nov. 16, 2009

(86) PCT No.: PCT/EP2009/065232

§ 371 (c)(1),
(2), (4) Date: Jun. 2, 2011

(87) PCT Pub. No.: WO2010/055160

PCT Pub. Date: May 20, 2010

(65) Prior Publication Data

US 2011/0232679 A1 Sep. 29, 2011

(30) Foreign Application Priority Data

Nov. 17, 2008 (EP) ..... 08169230

(51) Int. Cl.

| | |
|---|---|
| ***C23C 22/00*** | (2006.01) |
| ***C23F 11/04*** | (2006.01) |
| ***C23F 11/16*** | (2006.01) |
| ***C23F 11/173*** | (2006.01) |
| ***C23G 1/06*** | (2006.01) |
| ***C23G 1/08*** | (2006.01) |
| *C23C 22/06* | (2006.01) |
| *C23C 22/50* | (2006.01) |
| *C23C 22/56* | (2006.01) |

(52) U.S. Cl.

CPC ..... *C23F 11/04* (2013.01); *C23C 22/06* (2013.01); *C23C 22/00* (2013.01); *C23C 22/50* (2013.01); *C23C 22/56* (2013.01); *C23F 11/16* (2013.01); *C23F 11/173* (2013.01); *C23G 1/065* (2013.01); *C23G 1/081* (2013.01)

USPC ..... 510/258; 148/240

(58) Field of Classification Search

CPC ..... C23F 11/04; C23C 22/00; C23C 22/50; C23C 22/06; C23C 22/56

USPC ..... 252/395; 510/258

See application file for complete search history.

(56) References Cited

U.S. PATENT DOCUMENTS

| | | | |
|---|---|---|---|
| 1,780,594 | A | 11/1930 | Lawrence |
| 2,518,245 | A | 8/1950 | Morris et al. |

(Continued)

FOREIGN PATENT DOCUMENTS

| | | |
|---|---|---|
| DE | 28 56 587 | 8/1979 |
| DE | 29 48 261 | 7/1980 |

(Continued)

OTHER PUBLICATIONS

Dietsche, F., et al., "Organic Corrosion Inhibitors for Interim Corrosion Protection," NACE International, Corrosion Conference & Expo, No. 07358, pp. 1-12, (2007) XP 009134939.

(Continued)

*Primary Examiner* — Gregory Webb

(74) *Attorney, Agent, or Firm* — Oblon, Spivak, McClelland, Maier & Neustadt, L.L.P.

(57) ABSTRACT

The present invention relates to an acidic, aqueous composition which comprises a thiodiglycol alkoxylate for treating metallic surfaces. The invention furthermore relates to the use of one or more compound(s) of the general formula (I) as a corrosion inhibitor.

19 Claims, 1 Drawing Sheet

(56) References Cited

U.S. PATENT DOCUMENTS

| | | | | | |
|---|---|---|---|---|---|
| 2,858,274 | A | | 10/1958 | Matuszak et al. | |
| 3,470,146 | A | * | 9/1969 | Maclay | 526/209 |
| 3,997,614 | A | | 12/1976 | Lenke et al. | |
| 4,266,080 | A | | 5/1981 | Falk et al. | |
| 4,832,802 | A | | 5/1989 | Canaris | |
| 5,308,512 | A | * | 5/1994 | Stoll et al. | 510/524 |
| 5,417,841 | A | | 5/1995 | Frisby | |
| 5,470,493 | A | * | 11/1995 | Daute et al. | 8/137 |
| 5,976,416 | A | | 11/1999 | Brezinski | |

FOREIGN PATENT DOCUMENTS

| | | |
|---|---|---|
| EP | 0 878 605 | 11/1998 |
| JP | 10 130873 | 5/1998 |
| WO | 2005 033364 | 4/2005 |

OTHER PUBLICATIONS

BASF, "Performance chemicals for Metal Surface Treatment," BASF The Chemical Company, pp. 2-7, total 8 pages (Oct. 2005) XP 002587600.

BASF, "Lugalva® HS 1000; Product used to formulate brightener additives for the electroplating industry," BASF The Chemical Company, pp. 1-3, (Dec. 2006) XP 002587601.

BASF, "Chemicals for the Detergent and Formulator Industries," BASF The Chemical Company, total 10 pages, (Jun. 2009) XP 002587459.

International Search Report issued Jul. 1, 2010 in PCT/EP09/065232 filed Nov. 16, 2009.

* cited by examiner

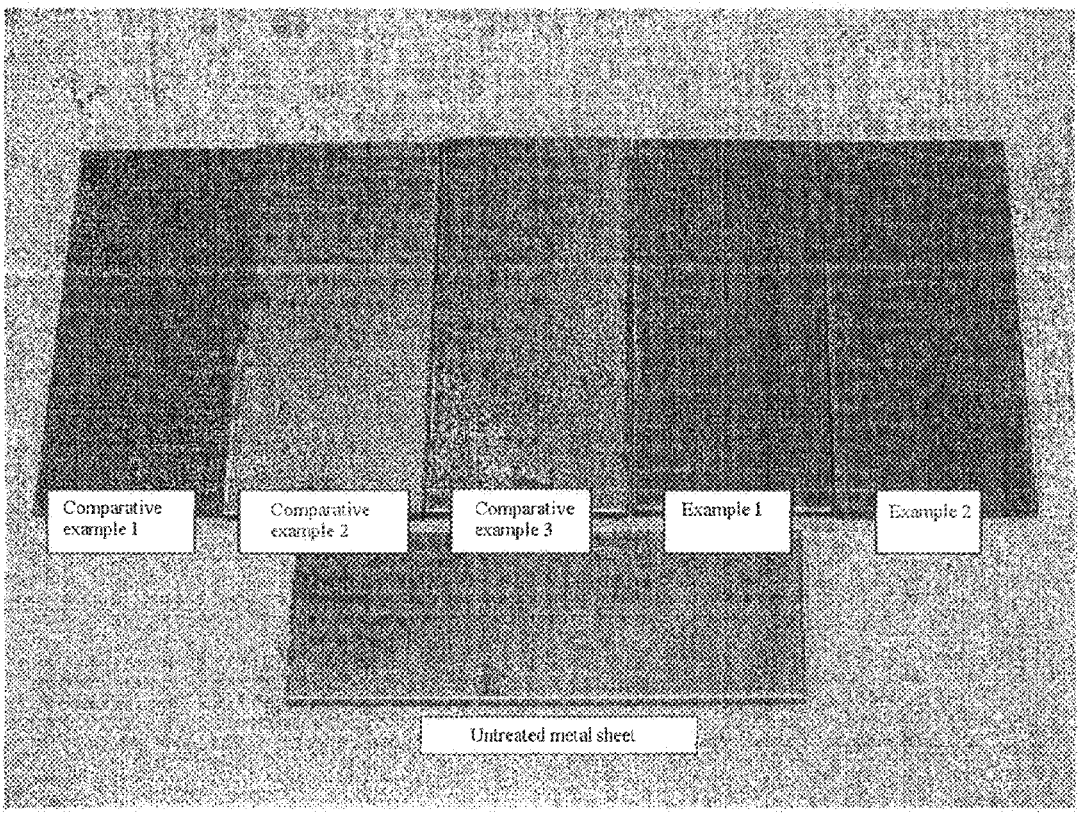
Comparative example 1
Comparative example 2
Comparative example 3
Example 1
Example 2
Untreated metal sheet

USE OF THIOGLYCOL ETHOXYLATE AS A CORROSION INHIBITOR

The present invention relates to an acidic, aqueous composition which comprises a thiodiglycol alkoxylate for the treatment of metallic surfaces.

In the treatment of metallic surfaces, the surface of a metal is treated with a treatment solution and thus changed by a chemical route. Here, surface layers, such as corrosion layers and deposits, are removed and, if appropriate, protective and effect layers are built up. In the case of metallic surfaces, the treatment serves especially for removing different oxide layers, such as rust or scale layers, and/or other impurities, such as fats, oils or lime, from the surface and/or for activating and/or protecting the surface. An example of a protective treatment is the acidic phosphatization of an iron or steel surface. The substantial element in the treatment or pickling is an attack on the metal. In phosphatization with an acidic zinc phosphate solution, many $H^+$ ions are consumed directly on the metal surface by the pickling attack of an acid on the metal, with the result that the pH increases locally. Only thereby is the solubility product for zinc phosphate exceeded so that zinc phosphate can be deposited in a thin layer on the surface.

In general, aqueous, inorganic or organic acids, in particular hydrochloric acid, phosphoric acid or sulfuric acid, and as a rule assistants, such as surfactants, are used for pickling. As a result, various metal components, such as reactors, pipelines, boilers, heat exchangers and the like, can be pickled or chemically cleaned. The components are cleaned to remove different iron oxides (rust), such as $Fe_2O_3$, $Fe_3O_4$, FeO and the like, and calcium and magnesium deposits, known as scale. During the pickling, a corrosion inhibitor is frequently added in a small amount to the acidic pickling solution, which corrosion inhibitor is intended to prevent or at least greatly slow down the dissolution of the base material, the metal, by corrosion.

It is known that alkyne alkoxylates can be used as corrosion inhibitors for strongly acidic pickling. These are described, for example, in WO 2005/033364.

JP-A 10-130873 teaches the use of polythiopolyetherdiols as a corrosion inhibitor. The compounds disclosed in this publication comprise at least two structural elements of the general formula —(O—R—S)—. The preparation of such polythiopolyetherdiols by means of polycondensation is disclosed in U.S. Pat. No. 2,518,245. Polymers which comprise a plurality of sulfur atoms are obtained thereby. These are then used in lubricants.

The use of polythiopolyetherdiols as a constituent of aqueous electroplating baths for the electrolytic deposition of a zinc coating is disclosed in DE 29 48 261.

It is an object of the invention to provide an acidic, aqueous composition for pickling metallic surfaces which comprises a corrosion inhibitor which is superior to the corrosion inhibitors known from the prior art, in particular in strongly acidic media and at high temperatures. Furthermore, it is an object of the invention to provide a process for pickling metallic surfaces, in particular steel surfaces, in which scarcely any pitting occurs even with the use of strongly acidic media.

This object is achieved by an acidic, aqueous composition for pickling metallic surfaces, comprising one or more acid(s), water and one or more compound(s) of the general formula (I)

$$HO—(A)_n(B)_m—C_pH_{p+2}—S—C_{p'}H_{p'+2}—(B)_{m'}(A)_{n'}—OH \quad (I)$$

with the meaning

A ethylenoxy

B $C_{3-5}$-alkylenoxy or mixtures thereof, it being possible for the groups A and B to be present in random distribution, alternately or in the form of two or more blocks in any sequence, n and n', in each case independently of one another, correspond to a number from 1 to 50, m and m', in each case independently of one another, correspond to a number from 0 to 50, and p and p', in each case independently of one another, correspond to an integer from 2 to 4.

In experiments and comparative experiments, it has been found that better corrosion protection in comparison with corrosion inhibitors known from the prior art can be achieved by the use of the compound(s) of the general formula (I) in strongly acidic media and at high temperatures during etching.

According to an embodiment of the invention, the compound according to the general formula (I) has very good corrosion protection properties if p and p' in each case correspond to the number 2.

The chain length of the group $-(A)_n(B)_m—$ or $—(B)_m(A)_n-$ may vary over wide ranges and is defined via the indices n and m and n' and m'. According to a general embodiment of the invention, n+m and n'+m', independently of one another, correspond in each case to an integer from 1 to 50, preferably an integer from 5 to 30, preferably an integer from 18 to 22, most preferably from 19 to 21.

In the thiodiglycol ethoxylate according to the invention and according to the general formula (I), first propylenoxy units and adjacent thereto ethylenoxy units may be present on the alcohol radicals of the compound $HO—C_pH_{p+2}—S—C_{p'}H_{p'+2}—OH$, where p and p', in each case independently of one another, are an integer from 2 to 4, preferably the number 2. Likewise, first ethylenoxy units and adjacent thereto propylenoxy units may be present. If n, n', m and m' each have a value of more than 1, the corresponding alkoxy radicals are preferably present in block form. n and m designate a mean value which is the average for the alkoxylates. In the alkoxylation of alkanols, in general a distribution of the degree of alkylation is obtained which can be adjusted to a certain extent by use of different alkylation catalysts. In the thiodiglycol ethoxylate according to the invention, first ethylenoxy units and adjacent thereto propylenoxy units, butylenoxy units and/or pentylenoxy units may also be present on the alcohol radicals. Furthermore, random mixtures of ethylene oxide units, propylenoxy units, butylenoxy units and/or pentylenoxy units may be present. Three-block or multiblock alkoxylation and mixed alkoxylation are also possible. It is furthermore also possible that preferably only ethylene oxide units (A) are present. Through the choice of suitable amounts of the groups (A) and (B), the property spectrum of the corrosion inhibitor according to the invention can be adapted according to practical requirements.

In the general formula (I), (B) is particularly preferably propylenoxy. n and n' are then particularly preferably, in each case independently of one another, a number from 1 to 25, m and m' are then, in each case independently of one another, preferably a number from 1 to 25.

According to a preferred embodiment of the invention, the proportion of the ethylene oxide units (A), based on the alkoxylates in the thiodiglycol ethoxylate according to the invention and according to the general formula (I), is 50 mol %, more preferably 70 mol %, particularly preferably 90 mol %, very particularly preferably 100 mol %.

According to a preferred embodiment, the present invention relates to the use of a thiodiglycol ethoxylate which is sold by BASF SE under the trade name Lugalvan® HS 1000.

Lugalvan® HS 1000 is a thiodiglycol ethoxylate which is prepared by ethoxylation of thiodiglycol under KOH catalysis at a temperature of 130° C., which ethoxylation is known to the person skilled in the art. The potassium hydroxide used is neutralized by addition of acetic acid after the end of the ethoxylation. The preparation is shown schematically below: $HO—CH_2—CH_2—S—CH_2—CH_2—OH$+n ethylene oxide gives $HO—(CH_2CH_2—O)_{n/2}—CH_2—CH_2—S—CH_2—CH_2—COCH_2(H_2)_{n/2}—OH$ under conditions known to the person skilled in the art, the molecular weight being about 1000 g/mol and n being about 20.

According to a general embodiment of the invention, thiodiglycol ethoxylates having a molecular weight of from 500 to 10,000, preferably from 750 to 2000, particularly preferably from 800 to 1200, g/mol have proven particularly suitable corrosion inhibitors.

The invention furthermore relates to a process for pickling metallic surfaces by treating metallic surfaces with the acidic, aqueous composition.

The process according to the invention can be used for pickling metallic surfaces of very different types. The metals may be pure metals and also alloys. Examples comprise surfaces of iron, cast iron, steel, nickel, zinc, brass or aluminum, in each case the uppermost metal layer which comes into direct contact with the aqueous composition according to the invention being meant. The metallic surface may be, for example, surface-finished steels, such as hot-galvanized or electrogalvanized steels. The process is suitable in particular for pickling surfaces of (cast) iron, stainless steel, steel or aluminum, very particularly preferably for steel surfaces. The process is suitable in particular for pickling the surface of strip metals, such as, for example, steel or aluminum strips.

The metallic surfaces may be outer surfaces of metallic materials, such as the surface of metallic strips, sheets or irregularly shaped workpieces, such as machine parts. Said metallic surfaces may also be inner surfaces, such as the inner surfaces of pipelines, heat exchangers, reactors, tanks, chemical plants, mineral oil transport systems or the like.

With the aid of the pickling process according to the invention, undesired surface layers and impurities are removed and a protective layer applied. Undesired surface layers may be in particular inorganic layers, for example substantially oxidic layers, such as rust layers, scale layers or layers which are formed during pickling of metals, for example of steel. These may be layers applied for temporary corrosion protection, such as, for example, phosphate layers, or layers of other materials, for example carbonate layers, such as lime layers or patina layers. The undesired layers may also be thin layers of organic materials, such as, for example, fat or oil layers.

The aqueous composition used in the process according to the invention comprises water and one or more acids in an amount of altogether from 60 to 99.99% by weight. Here and below, the stated percentages are always based on the amount of all components of the aqueous composition according to the invention.

The total amount of water and acid is preferably from 60 to 99.99% by weight and very particularly preferably from 80 to 99.99% by weight.

The acid may be an inorganic acid, such as, for example, hydrochloric acid, hypochlorous and chlorous acid, sulfuric acid, amidosulfonic acid, phosphoric acid or phosphorous acid, or an organic acid, such as, for example, formic acid, methanesulfonic acid, acetic acid or citric acid or succinic acid. Of course, mixtures of different acids may also be used, for example mixtures of hydrochloric acid and phosphoric acid. The acid is preferably sulfuric acid, methanesulfonic acid or phosphoric acid.

The respective amount of water and acid depends firstly on the desired use of the preparation and also on the type of acid. While, with the use of phosphoric acid, the solvent may consist in particular cases exclusively of concentrated (i.e. 85% strength) phosphoric acid, strong dilutions are advantageous with the use of acids other than phosphoric acids. If acids other than phosphoric acid are used, the composition according to the invention comprises as a rule at least 50% by weight of water, preferably at least 60% by weight of water. The total amount of water in the composition according to the invention is calculated here as the sum of the water which is added together with the acid and of the water which is added in pure form or in the form of solutions of other materials.

According to a general embodiment, the compound of the general formula (I) which is present in the composition according to the invention is present in an amount of from 0.01 to 2% by weight, particularly in an amount of from 0.05 to 2% by weight, particularly preferably in an amount of from 0.1 to 1% by weight, in the composition according to the invention. All concentration data are based on the ready-to-use composition. It is of course possible first to prepare a concentrate which is diluted to the desired concentration only on site.

The composition according to the invention which is used in the process furthermore comprises as a rule one or more additives or assistants, although the addition thereof is not absolutely essential in every case. The amount of such additives is from 0 to 38% by weight, preferably 0.01 to 30% by weight and particularly preferably from 0.1 to 20% by weight.

Assistants are in particular from 0.01% by weight to 20% by weight of at least one surface-active substance. From 0.1 to 10% by weight and particularly preferably from 0.5 to 8% by weight of the surface-active substance are preferably used. Examples of suitable surface-active substances comprise customary anionic, cationic or nonionic surfactants.

Suitable nonionic surfactants are in particular:

- Alkoxylated $C_8$-$C_{22}$-alcohols, such as fatty alcohol alkoxylates, oxo alcohol alkoxylates and Guerbet alcohol ethoxylates: the alkoxylation can be effected with ethylene oxide, propylene oxide and/or butylene oxide. Block copolymers or random copolymers may be present. They usually comprise from 2 to 50 mol, preferably from 3 to 20 mol, of at least one alkylene oxide per mole of alcohol. A preferred alkylene oxide is ethylene oxide. The alcohols preferably have 10 to 18 carbon atoms.
- Alkylphenol alkoxylates, in particular alkylphenol ethoxylates, which comprise $C_6$-$C_{14}$-alkyl chains and from 5 to 30 mol of alkylene oxide/mol.
- Alkylpolyglucosides, which comprise $C_8$-$C_{22}$-alkyl chains, preferably $C_{10}$-$C_{18}$-alkyl chains, and as a rule from 1 to 20, preferably from 1.1 to 5, glucoside units.
- N-Alkylglucamides, fatty acid amide alkoxylates, fatty acid alkanolamide alkoxylates and block copolymers of ethylene oxide, propylene oxide and/or butylene oxide.

Examples of suitable anionic surfactants are:

- Sulfates of (fatty) alcohols having 8 to 22, preferably 10 to 18, carbon atoms, in particular $C_9C_{11}$-alcohol sulfates, $C_{12}C_{14}$-alcohol sulfates, $C_{12}$-$C_{18}$-alcohol sulfates, lauryl sulfate, cetyl sulfate, myristyl sulfate, palmityl sulfate, stearyl sulfate and tallow fatty alcohol sulfate.
- Sulfated alkoxylated $C_8$-$C_{22}$-alcohols (alkyl ether sulfates): compounds of this type are prepared, for example, by first alkoxylating a $C_8$-$C_{22}$-alcohol, preferably a $C_{10}$-$C_{18}$-alcohol, e.g. a fatty alcohol, and then sulfating the alkoxylation product. Ethylene oxide is preferably used for the alkoxylation.

Linear $C_8$-$C_{20}$-alkylbenzenesulfonates (LAS), preferably linear $C_9$-$C_{13}$-alkylbenzenesulfonates and -alkyltoluenesulfonates.

Alkanesulfonates, in particular $C_8$-$C_{24}$-alkanesulfonates, preferably $C_{10}$-$C_{18}$-alkanesulfonates.

Soaps, such as the Na and K salts of $C_8$-$C_{24}$-carboxylic acids.

The anionic surfactants are preferably added in the form of salts. Suitable cations are, for example, alkali metal ions, such as sodium, potassium and lithium, and ammonium salts, such as hydroxyethylammonium, di(hydroxyethyl)ammonium and tri(hydroxyethyl)ammonium salts.

The following may be mentioned as particularly suitable cationic surfactants:

$C_7$-$C_{25}$-alkylamines

N,N-dimethyl-N-(hydroxy-$C_7$-$C_{25}$-alkyl)ammonium salts mono- and di-($C_7$-$C_{25}$-alkyl)dimethylammonium compounds quaternized with alkylating agents;

ester quats, in particular quaternary esterified mono-, di- and trialkanolamines which are esterified with $C_8$-$C_{22}$-carboxylic acids;

imidazoline quats, in particular 1-alkylimidazolinium salts of the formulae III or IV (III)

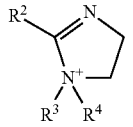

(IV)

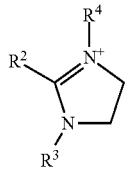

in which the variables have the following meaning:

$R^2$ $C_1$-$C_{25}$-alkyl or $C_2$-$C_{25}$-alkenyl;

$R^3$ $C_1$-$C_4$-alkyl or hydroxy-$C_1$-$C_4$-alkyl;

$R^4$ $C_1$-$C_4$-alkyl, hydroxy-$C_1$-$C_4$-alkyl or a radical $R^4$—(CO)—X—$(CH_2)_p$—(X: -0- or —NH—; p: 2 or 3), at least one radical $R^2$ being $C_7$-$C_{22}$-alkyl.

Of course, a plurality of different surfactants may also be used. Persons skilled in the art make a suitable choice from the surface-active substances depending on the desired application. Proposed formulations can be taken from the relevant literature, for example the technical information of BASF AG "Technische Reinigungsmittel", January 1993 edition.

Nonionic surfactants are preferably used.

The additives are in general from 0.01% by weight to 20% by weight of at least one dispersant. Examples of suitable dispersants comprise dispersing, water-soluble polymers (generally polyanions), such as polyacrylic acids having a molecular weight of from 1000 to 100,000 or copolymers of acrylic acid with maleic anhydride having a molecular weight of from 1000 to 100,000, aromatic sulfonic acid condensates, such as phenolsulfonic acid, or naphthalenesulfonic acid with formaldehyde.

The composition according to the invention which is used may also comprise further components or assistants, depending on the desired use.

In order to improve the removal of fats during the degreasing by pickling, it may be advantageous to add small amounts of water-miscible organic solvents to the composition according to the invention. The amount of optionally added organic solvents is in general from 0 to 10% by weight. Examples of suitable water-miscible solvents comprise monoalcohols, such as methanol, ethanol and propanol, higher alcohols, such as ethylene glycol or polyethylene glycols, and ether alcohols, such as butyl glycol and methoxypropanol.

Examples of further assistants comprise antifoams, such as polypropoxylates or silicone ethers. The type and amount of additional components or assistants are determined by the person skilled in the art according to the desired use. The amount of optionally added further assistants is in general from 0 to 5% by weight.

In the process according to the invention, the metallic surface is brought into contact with the aqueous composition according to the invention, for example by spraying, immersion or roll-coating. After an immersion process, the workpiece can be allowed to drip for removal of excess treatment solution; however, in the case of metal sheets, metal foils and the like, excess treatment solution can, for example, also be removed by means of a squeegee.

According to an embodiment of the invention, metallic surfaces in the interior of plants can also be treated. Deposits in tanks, reactors, pipelines, heat exchangers or the like can be removed by filling the plant with the composition according to the invention or flushing said plant therewith. The dissolution of deposits can be accelerated by circulating the composition according to the invention in the plant by pumping.

According to a further embodiment of the present invention, the composition according to the invention or the process according to the invention is employed for the pickling of plants which are used in oil and gas extraction. So-called scale deposits in pipelines, which may be injection or production drill lines, are thus removed by means of the composition according to the invention. According to a preferred embodiment, the composition according to the invention is used for pickling pipelines which are used in so-called acidizing.

A further field of use is the use of the composition according to the invention for protecting chemical apparatuses in the case of acid-catalyzed reactions from attack by acids on metallic components or pipelines of the apparatus.

The process according to the invention can optionally also comprise one or more pretreatment steps. For example, the metallic surface can be cleaned with the composition according to the invention, for example to remove fats or oils, prior to pickling.

Furthermore, the process may optionally comprise aftertreatment steps. Washing steps in which the treated surface is subsequently washed with suitable cleaning liquids, in particular water, in order to remove, for example, residues of the composition according to the invention from the surface may be mentioned in particular here.

"No-rinse" processes in which the treatment solution is dried directly in a drying oven immediately after application, without washing off, are also possible.

The treatment during the process according to the invention can be effected batchwise or continuously. A continuous process is suitable in particular for the treatment of strip metals. Here, the metal strip is moved through a tray or washing apparatus and optionally through further pretreatment and aftertreatment stations.

Temperature and duration of the treatment are determined by the person skilled in the art according to the desired use. A higher temperature accelerates firstly the pickling attack on the undesired layers to be detached and secondly also the pickling attack on the metal itself. In general, the process according to the invention is carried out at a temperature in the range from 60 to 90° C., preferably at a temperature in the range from 80 to 90° C. The duration of treatment may be from 1 second to several hours. During the pickling of steel strips, a temperature of from 60 to 80° C., for example 70° C., in combination with contact times of from 1 to 10 seconds has proven particularly useful.

In the process according to the invention, the pickling attack on the metal is substantially more greatly inhibited than is the case with the use of corrosion inhibitors from the prior art.

The following examples are intended to illustrate the invention in more detail:

EXAMPLES AND COMPARATIVE EXAMPLES

The following solutions were used for the examples and comparative examples:

In each case solutions of corrosion inhibitor (if present) in water were prepared. The amounts of corrosion inhibitor are shown in table 1. The proportion of sulfuric acid was 10% by weight in each case.

General Experimental Method

1. Measuring Principle

Defined test sheets comprising steel 1.0037 having dimensions of 20×50×1 mm were cleaned electrolytically under alkaline conditions, in each case immersed in a test solution (cf. solutions 1 to 5) for 24 hours at 40° C. and the mass loss based on surface area was determined gravimetrically by means of differential weighing.

The preparation or cleaning of the metal sheets is effected according to ISO 8407 specifically for the material and is mentioned explicitly here for steel 1.0037.

2. Preparation of the Metal Sheets

Degreasing: A solution of the degreasing bath of the following composition is used in a plastic tray having two sheet-like electrodes (stainless steel or graphite) which are larger than the test metal sheet:

20 g of NaOH 22 g of $Na_2CO_3$ 16 g of $Na_3PO_4.12H_2O$ 1 g of ethylenediaminetetraacetic acid (EDTA)

0.5 g of nonionic surfactant: alkylphenol, ethoxylated, 10 ethylene oxide units on average about 940 ml of demineralized water NaOH, $Na_2CO_3$ and $Na_3PO_4$ are dissolved in succession in demineralized water with stirring. At the same time, EDTA and the surfactant are dissolved separately in demineralized water, this being effected in the case of the surfactant solution at a temperature of 50° C. The solutions of EDTA and surfactant are then added to the sodium hydroxide solution in a measuring cylinder and, after cooling, made up to 100 ml with demineralized water.

Derusting: A solution of the derusting bath of the following composition is used in a plastic tray having two sheet-like electrodes which are larger than the test metal sheet:

100 g of diammonium citrate in 1000 ml of water

A steel sheet measuring 20 mm×50 mm×1 mm is wiped off with a paper cloth and immersed at 10 volt in the degreasing bath between the electrodes and connected as the cathode. The voltage is adjusted so that the current is 1 ampere (A). After 10 seconds, the steel sheet is removed and is washed under running water for 5 seconds. The steel sheet is immersed at 10 volt in the derusting bath to the electrodes and connected as the cathode. The voltage is adjusted so that the current is 1 ampere (A). After 3 minutes, the steel sheet is removed and is washed under running demineralized water for 5 seconds, blown off with air and used immediately for the test.

3. Pickling Tests

The metal sheet measuring 20 mm×50 mm×1 mm is electrolytically degreased and derusted.

The initial mass is determined by means of an analytical balance. The metal sheet is used immediately after weighing. The prepared metal sheet is placed obliquely in a 200 ml glass bottle with test solution. The angle between steel sheet and bottom is 35°. The glass bottle is firmly closed and is stored at room temperature. During the storage, the glass bottle is briefly shaken once every 6 hours.

The metal sheet is removed from the solution, washed with demineralized water, brushed with steel wool, washed with demineralized water and blown dry with air. The mass is then determined.

Simultaneously with the test, a determination without pickling inhibitor and with Korantin® PM, available from BASF SE, was carried out. This is a propargyl alcohol alkoxylate having 1 to 2 ethylene oxide units.

4. Evaluation of the Results

For each metal sheet, the difference between first and second weighing is noted in mg/cm$^2$ ($\Delta m_{sample}$).

Examples 1 and 2, Comparative Examples 1 to 3

For the experiments, solutions 1 to 5 were used (proportion of sulfuric acid 10% by weight). The metal removed, based on area, at 40° C. after 24 hours was determined for sheets of steel 1.0037 according to the method described above in general. Corrosion inhibitors shown in table 1 were used in the amounts shown. The results are summarized in table 1.

TABLE 1

Tests with solutions 1 to 5 ($H_2SO_4$ = 10% by weight)

| | Inhibitor | Weight [g] | Weight 24 [h/g] | Amount removed [g] | Amount removed [%] | Amount removed/year [mm/a] |
|---|---|---|---|---|---|---|
| Comparative | — | 7.8070 | 4.9042 | 2.9028 | 37.2 | 66.0 |
| example 1 | | 7.7439 | 3.5316 | 4.2123 | 54.2 | 95.8 |
| Comparative | Korantin ® | 7.7063 | 7.6480 | 0.0583 | 0.8 | 1.3 |
| example 2 | PM (1) 0.1% | 7.7974 | 7.7426 | 0.0548 | 0.7 | 1.2 |
| Comparative | Korantin ® | 7.6180 | 7.5220 | 0.0960 | 1.3 | 2.2 |
| example 3 | PM (1) 0.4% | 7.700 | 7.7065 | 0.0635 | 0.8 | 1.4 |
| Example 1 | Lugalvan ® | 7.7286 | 7.7106 | 0.0180 | 0.2 | 0.4 |
| | HS1000 (2) 0.1% | 7.7460 | 7.7276 | 0.0184 | 0.2 | 0.4 |

TABLE 1-continued

| Tests with solutions 1 to 5 ($H_2SO_4$ = 10% by weight) | | | | | | |
|---|---|---|---|---|---|---|
| | Inhibitor | Weight [g] | Weight 24 [h/g] | Amount removed [g] | Amount removed [%] | Amount removed/year [mm/a] |
| Example 2 | Lugalvan ® | 7.8010 | 7.7875 | 0.0135 | 0.2 | 0.3 |
| | HS1000 (2) 0.4% | 7.8168 | 7.8040 | 0.0128 | 0.2 | 0.3 |

(1) Korantin ® PM
(2) Lugalvan ® HS 1000.

The examples show that the corrosion inhibitors used according to the invention exhibit considerably better inhibition than Korantin® PM. Thus, a corrosion inhibitor is available which shows a considerably better effect compared with that obtainable from the prior art in the case of steel surfaces.

The photographs of the surfaces of the individual samples are collected together in FIG. 1.

FIG. 1 shows that the corrosion is substantially inhibited by the corrosion inhibitor used according to the invention, in particular not only in comparison with a sample without corrosion inhibitor but also in comparison with a commercially available corrosion inhibitor Korantin® PM.

We claim:

1. A process for pickling a metallic surface, the process comprising:

treating the metallic surface with an acidic, aqueous composition, wherein the composition comprises:

an acid;

water; and a compound of formula (I)

$$HO—(A)_n(B)_m—C_pH_{p+2}—S—C_{p'}H_{p'+2}—(B)_{m'}(A)_{n'}—OH \quad (I),$$

where

A is ethylenoxy,

B is $C_{3-5}$-alkylenoxy or at least one mixture of $C_{3-5}$-alkylenoxy groups, A and B are present in random distribution, alternately, or in the form of two or more blocks in any sequence, n and n' each independently correspond to a number of from 1 to 50, m and m' each independently correspond to a number of from 0 to 50, and p and p' each independently correspond to an integer of from 2 to 4.

2. The process of claim 1, wherein the metallic surface comprises iron, steel, brass, or aluminum.

3. The process of claim 1, wherein said treating is carried out at a temperature in a range of from 60 to 90° C.

4. The process of claim 1, wherein the surface is a surface of a pipeline.

5. A method of inhibiting corrosion, comprising:

treating a material with a compound of formula (I)

$$HO—(A)_n(B)_m—C_pH_{p+2}—S—C_{p'}H_{p'+2}—(B)_{m'}(A)_{n'}—OH \quad (I)$$

wherein

A is ethylenoxy

B is $C_{3-5}$-alkylenoxy or at least one mixture of $C_{3-5}$-alkylenoxy groups, A and B are present in random distribution, alternately, or in the form of two or more blocks in any sequence, n and n' each independently correspond to a number of from 1 to 50, m and m' each independently correspond to a number of from 0 to 50, p and p' each independently correspond to an integer of from 2 to 4, and the compound of formula (I) serves as a corrosion inhibitor.

6. The process of claim 1, wherein p and p' in the compound of formula (I) are 2.

7. The process of claim 1, wherein a proportion of the ethylenoxy (A) in the compound of formula (I) is at least 50 mol %.

8. The process of claim 1, wherein m and m' in the compound of formula (I) are 0.

9. The process of claim 1, wherein the acid is at least one selected from the group consisting of hydrochloric acid, sulfuric acid, methanesulfonic acid and phosphoric acid.

10. The process of claim 1, wherein the composition further comprises: from 0.01 to 20% by weight of a surface-active substance.

11. The process of claim 1, wherein an amount of water and the acid is from 80 to 99.99% by weight.

12. The process of claim 1, wherein an amount of the compound of formula (I) is from 0.01 to 2% by weight.

13. The process of claim 1, wherein the composition has a pH of from 0 to 2.

14. The process of claim 6, wherein a proportion of the ethylenoxy (A) in the compound of formula (I) is at least 50 mol %.

15. The process of claim 6, wherein m and m' in the compound of formula (I) are 0.

16. The process of claim 6, wherein the acid is at least one selected from the group consisting of hydrochloric acid, sulfuric acid, methanesulfonic acid, and phosphoric acid.

17. The process of claim 7, wherein m and m' in the compound of formula (I) are 0.

18. The process of claim 7, wherein the acid is at least one selected from the group consisting of hydrochloric acid, sulfuric acid, methanesulfonic acid, and phosphoric acid.

19. The process of claim 8, wherein the acid is at least one selected from the group consisting of hydrochloric acid, sulfuric acid, methanesulfonic acid, and phosphoric acid.

* * * * *